US005296685A

United States Patent [19]

Burstein et al.

[11] Patent Number: 5,296,685

[45] Date of Patent: Mar. 22, 1994

[54] HEATING COIL STRUCTURES

[75] Inventors: Norman Burstein, Philadelphia, Pa.; John Stein, Ewing, N.J.

[73] Assignee: Quartz Tubing, Inc., Philadelphia, Pa.

[21] Appl. No.: 46,491

[22] Filed: Apr. 9, 1993

Related U.S. Application Data

[63] Continuation-in-part of Ser. No. 818,054, Jan. 8, 1992, abandoned.

[51] Int. Cl.[5] ..... H05B 3/40; H01C 1/026; H01J 1/15; H01J 19/08

[52] U.S. Cl. ..... 219/534; 392/407; 338/234; 313/343

[58] Field of Search ..... 338/218, 261, 267, 282

[56] References Cited

U.S. PATENT DOCUMENTS

| | | | |
|---|---|---|---|
| 2,625,666 | 1/1953 | Williams | 313/343 |
| 3,073,986 | 1/1963 | Hodge | 313/578 |
| 3,219,872 | 11/1965 | Hodge | 313/272 |
| 3,509,411 | 4/1970 | Walter | 313/343 |
| 3,596,057 | 7/1971 | Arntz | 219/553 |
| 3,904,851 | 9/1975 | Gustafson et al. | 219/542 |

FOREIGN PATENT DOCUMENTS

| | | | |
|---|---|---|---|
| 1138859 | 2/1985 | U.S.S.R. | 313/343 |

*Primary Examiner*—Bruce A. Reynolds
*Assistant Examiner*—Michael D. Switzer
*Attorney, Agent, or Firm*—Dilworth & Barrese

[57] ABSTRACT

A heating element formed from at least two wires twisted together. The twisted wires are preferably shaped in a helical configuration and mounted within a quartz tube.

21 Claims, 2 Drawing Sheets

HEATING COIL STRUCTURES

This is a continuation-in-part of copending application Ser. No. 07/818,054 filed on Jan. 8, 1992.

BACKGROUND OF THE INVENTION

1. Field of the Invention

The present invention relates generally to radiant heaters and more specifically to heating coils for use in such heaters.

2. Description of the Prior Art

Radiant heaters, which generate heat by passing an electrical current through a high resistance element, have become common place. However, new applications are continually being devised. With the dwindling supply of fossil fuels and their associated spiraling costs, more homes are using electrical radiant heaters as their primary or secondary heating source. Portable electric space heaters have also seen an increase in popularity. Large commercial space heaters for warehouses, garages and the like are also more common. Hand dryers, like those found in many public restrooms, and hair dryers, which are common in the home, also require radiant heater elements. With the advent of electrically powered cars, it is expected that highly efficient electric heating elements to heat the passenger compartment will be needed.

The electric current passes through a resistive heating element; in one form the heating element is exposed to the ambient, and in another form it is protected within a tube such as quartz or metal. Quartz heater tubes utilizing high temperature heating elements are common in the food service, graphic arts, and the industrial processing field. Applications in which quartz heaters can be found include very high speed drying of print, broiling and baking of foods in restaurants, drying ceramics and sealing plastics (e.g., bag forming processes). Quartz heaters are also replacing normal heating elements in stove stop ovens.

A typical heating tube consists of a high resistance wire wrapped in a helical configuration. The respective free ends of the helix are connected to a copper or other electrically conductive metal that serves as a common terminal point for that end. The helically configurative element is often suspended within a quartz or metal tube. The tube may be capped with ceramic end pieces or caps, and the helical heating element is held in tension by the end caps.

Some quartz heating tubes are vacuum sealed and may contain an inert gas. Frequently, special control circuitry is required because of an initial in-rush current when these devices are first activated.

A typical helical heating element may be, for example, from three inches to seventy-two inches long and from 0.250 inch to one inch in diameter. Generally, the helical structure is extended to space each coil from the adjacent coils. The wire has a diameter as required and is made of an alloy of iron, chromium, aluminum and cobalt which has a recommended operating temperature range that extends only to about 900 degrees centigrade. Though the alloy's melting point may exceed 900 degrees centigrade (e.g., 1280 degrees), the prior helical heating coil cannot effectively operate at such high temperatures.

In a typical commercial application, such as a cooking oven, heating elements are connected in an electrical series configuration. The size and wattage of the heating elements are designed for that particular oven.

The heating element is usually connected to an external terminal mounted on the tube's end caps. For example, a conically shaped termination for use in spring loaded sockets is often used. Studs, nuts, and pigtails are also common terminals. The terminal configuration depends on the application.

Quartz tubing has become increasingly popular to protect the heating element since it is durable and transparent to infrared radiation. The quartz tubing may be clear, semi-translucent or translucent.

SUMMARY OF THE INVENTION

The present invention utilizes two or more wires wrapped around each other before being shaped in a helical configuration. The composition of the wires is preferably a combination of iron, cobalt, aluminum and chromium, commonly referred to as iron, chrome, aluminum wire.

The wires are connected to typical terminals, i.e. pigtails, studs, bolts, and the like. It may be mounted within a quartz tube, but no vacuum or vapor is required inside the tube. Therefore, there is almost no in-rush current and no special control circuitry is required. A simple switch or a common silicon controlled rectifier (SCR) may be used to control the current to the heating element and thereby control the operating temperature. The operating temperatures of a twisted wire heating coil can typically reach 100 degrees centigrade. The twisted wire heating element does not collapse or sag at this temperature; while the prior art single wire heater coil would collapse at such high temperatures.

For the same application, the instant heating element uses two smaller gauge wires, relative to that of the single wire prior heating elements. The instant heating element rapidly heats up to its operating temperature. The cool-down time is also reduced. The increase in surface area of the wires, over prior art heating elements, further helps to reduce the cool down time. Therefore, the heater can be turned "off" and "on" very rapidly and can be accurately adjusted to any temperature between the highest and lowest temperatures.

The same or greater amount of heat can be generated in a smaller volume. Therefore, the quartz glass used to encase the heating elements can be smaller. A significant economic savings can be realized since the quartz tubes are an expensive component of a quartz heater. Typically, twice the power rating can be achieved in the same or smaller volume of the quartz tube, i.e., more watts per square inch of cross section.

It is an object of the present invention to provide radiant heaters which takes up less volume than conventional radiant heaters for the same output power.

It is a further object to provide a heating element that reaches the preferred operating temperature faster and cools down faster than conventional heating elements.

Another object of the present invention is to provide an improved quartz tube heater at a lower cost than quartz halogen tube heaters.

A further object is to provide a heating element that does not collapse or sag at high temperatures.

Still another object of the present invention is to provide a heating element with improved construction and operation capabilities.

Other objects and advantages of the present invention will be apparent from the following detailed description of the presently preferred embodiment, when read together with the accompanying drawings.

DETAILED DESCRIPTION OF THE PREFERRED EMBODIMENT

Figure 2:
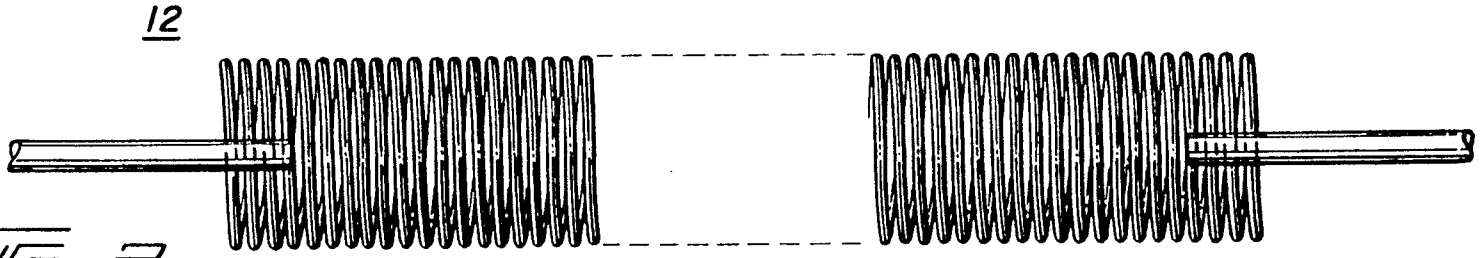
FIG. 2 PRIOR ART
FIG. 2 illustrates the helical structure of the prior art single wire heating elements.
Figure 1:
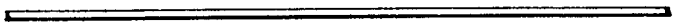
FIG. 1 PRIOR ART
FIG. 1 illustrates a single wire conductor used in the prior art heating elements.

FIGS. 1 and 2 show a typical single resistive wire 10 used as a heating element and the single resistive wire 10 in its helical heating element configuration 12. The preferred embodiment of the present invention, shown in FIG. 3, employs at least two wires 21, 22 twisted together. The preferred wires are composed of an alloy consisting of iron, chromium, aluminum and cobalt. One suitable alloy is the AF alloy available from the Kanthal Corporation of Bethel, Conn.

Figure 3:
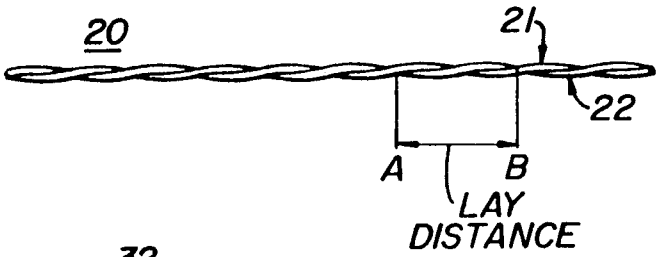
FIG. 3 is a multi-wire conductor in accordance with the present invention.

Although FIG. 3 illustrates the use of wires 21, 22 with a circular cross-section, any geometric configuration of high resistance conductor may be employed.

In the preferred embodiment, the wires are initially of equal length and are in a physically parallel relationship with each other. The wires are then twisted, preferably tightly, about each other, and the result is the twisted structure 20 shown in FIG. 3. Depending on the application, the number of twists per linear dimension and various twisting configurations can be utilized. For example, one of the wires can initially be longer than the other wire(s) and is twisted in such a manner so that the starting and end points after twisting are the same for all wires. In wire technology, the lay distance of twisted wire is the longitudinal length over which one of the twisted wires moves 360° about a respective wire. Referring to FIG. 3, the lay distance of the twisted wires 21, 22 corresponds to the longitudinal distance between points A and B. In the present invention it has been found that the lay distance for a twisted wire heating element having substantially mutually supporting contacting wires is proportional to the diameter of the individual wires making up the heating element. Preferably, the lay distance is between about 9 and 11 times greater than the diameter of the individual wire comprising a portion of the heating element. Most preferably, the lay distance is a factor of ten times greater than the wire diameter. For example, the table below shows the relative proportions for three common wire gauges:

TABLE 1

| Wire Gauge | Diameter (in.) | Lay Distance (in.) |
|---|---|---|
| 16 | .0510 | .510 |
| 25 | .0179 | .179 |
| 30 | .0101 | .101 |

By selecting the appropriate lay distance, the heating element can be formed so as to provide the optimum efficiency while maintaining sufficient supporting relation between the wires of the heating element.

Figure 4:
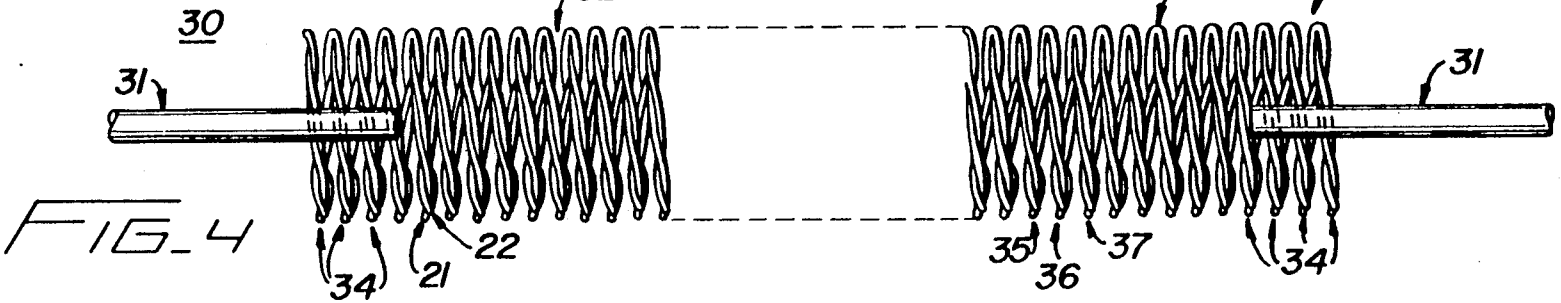
FIG. 4 is a multi-wire conductor helical heating element in accordance with the present invention.

As shown in FIG. 4, the twisted wires 21, 22 of the invention are turned into the successive turns or coils 35, 36, 37 etc. of a helix 33. A single helix 33 is formed, but the representation of two separated sections of that helix, as depicted in FIG. 4, permits simplicity and economy of drawing.

The gauge of each wire 21, 22 is preferably the same, but it is not mandatory. The gauge of the wire, length of the coil and diameter of the coil is determined by the particular need.

In a specific purpose or use, the diameter of wires 21, 22 would be less than the diameter of wire 10. In addition, the length of the helical coil 33 would be less than the length of coil 12. All other parameters of the heater remaining the same, e.g. diameter of the helix, desired output wattage, etc.

A plurality of turns 34 at each end of the helix 33 terminate at a common electrical connection or internal conductor 31. In the preferred embodiment, the wires are welded and/or crimped to internal electrical conductor 31 forming a contact or terminal at each end of the heating element.

The internal conductors 31 can be attached to the various stock terminations in the normal manner, e.g. welding, compression fitting, etc.

The axial spacing, indicated at 32, between adjacent coils may be adjusted depending on the application. Adjusting the spacing 32 for a given physical length determines the maximum output power of the heating element.

Figure 5:
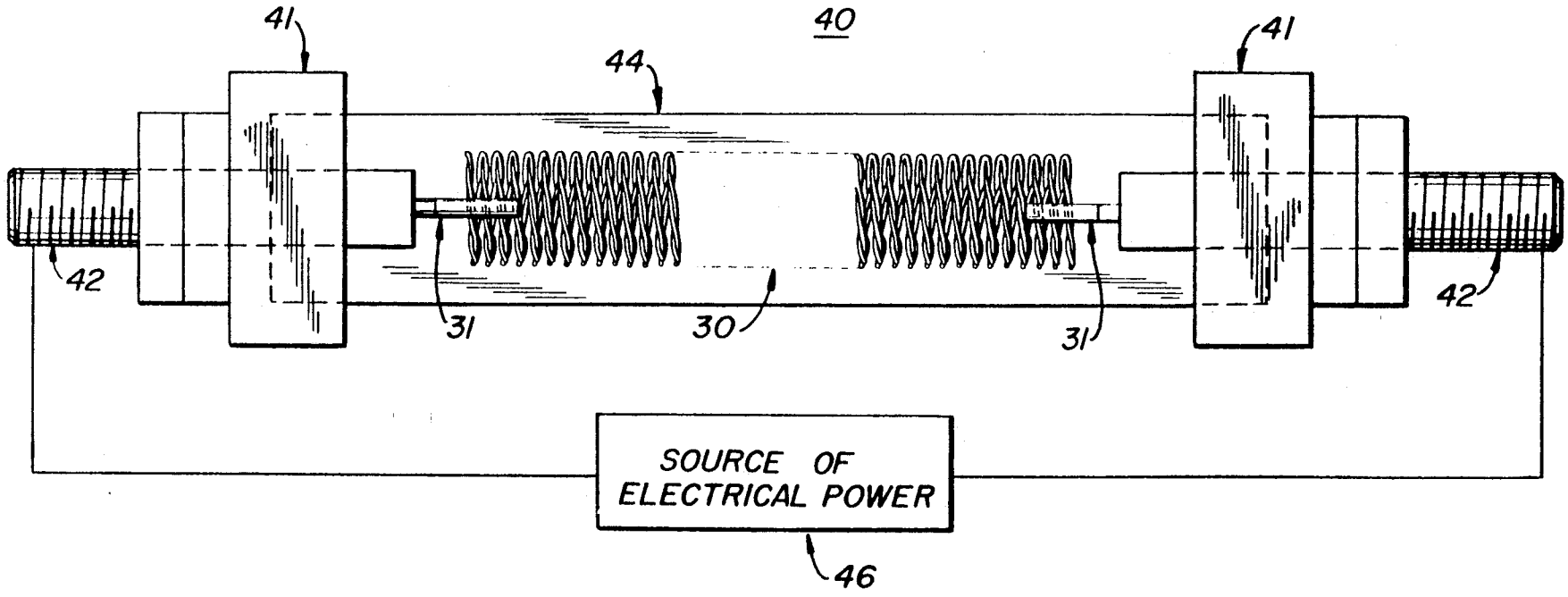
FIG. 5 is a multi-wire quartz tube heater in accordance with the present invention.

In FIG. 5, the heating element is shown suspended within a tube 44. In the preferred embodiment, the tube is made of quartz. The internal conductors 31 are shown as attached to studs 42, however, any of the common external or stock terminations, e.g. pigtails, conical for spring loaded sockets, etc., may be used. The threaded studs 42 are respectively adjustably mounted in end caps 41 on each end of the quartz tube 44. In a preferred embodiment, the heating element 30 is held at a slight tension between the two studs 42. This tension determines the spacing 32 between adjacent coils.

A source 46 of electrical power is connected across the internal conductors 31; any suitable AC or DC source may be used.

Because of the composition of the wire, the interior of the quartz tubing does not have to be evacuated nor does it have to be back-filled with an inert gas to attain the desired high temperature operation. This simplifies the construction of the instant heating tube and further reduces costs. Since there is no inert gas present, when the heating element is turned on, the in-rush current is negligible. Therefore, special control circuity to adjust the current is not required.

The current to the heating element can be controlled by a simple switch or by a silicon controlled rectifier (not shown). An SCR can be used to simply turn the heating element off and on, or to gradually increase the current so that a range of temperatures can be attained.

The multi-conductor heating element may operate at temperatures over 1000 degrees centigrade. The prior art heating elements generally begin to sag at less than 1000 degrees centigrade and would melt at about 1280 degrees centigrade. The twisted wires 21, 22 tend to reinforce each other and prevent sagging at the higher temperatures.

Another advantage of the multi-conductor heating element is that it heats up to the desired temperature more quickly than the prior art heating elements and also cools down quicker.

With the present invention, a shorter linear dimension and a smaller diameter helical heating element can be used for the same or higher wattage. Therefore, a smaller quartz tube, an expensive component, will suffice and a significant savings in cost can be realized.

What is claimed is:

1. An electrical heater having a helix of coils of resistance wire characterized by each turn of the wire of said coils being formed of a plurality of wires twisted together in a plurality of twists, and electrical means, forming an electrical connection at each end of said twisted wires, for applying a source of electrical power across said helix via said connections, said twisted wires having a lay distance which between about 9 and 11 times greater than the individual diameter of said wires, said wires being in continuous contact along their respective lengths between said electrical connections, said heater helix being unsealed from the ambient.

2. The electrical heater of claim 1 wherein said helix of coils of resistance wire is suspended within a heater tube.

3. The electrical heater of claim 2 wherein said tube is quartz.

4. Ana electrical heater of the type having coils of resistance wire in a tube, the heater characterized by a plurality of resistance wires twisted together in a plurality of twists and then formed into the coils, said twisted wires having a lay distance which is between about 9 and 11 times greater than the individual diameter of said wires.

5. An electrical element for a heater comprised of at least two high resistance conductors twisted about each other and being in continuous contact along their respective lengths, with first ends of the conductors electrically connected in a first common terminal and second ends of the conductors electrically connected in a second common terminal, said twisted high resistance conductors having a lay distance which is between about 9 and 11 times greater than the cross-sectional distance of said conductors and means for connecting said first and second common terminals in the energizing circuit of a heater.

6. The electrical heater element of claim 5 wherein said conductors are wires.

7. The electrical heater element of claim 5 wherein the conductors are of substantially equal length.

8. The electrical heater element of claim 5 wherein said electrical conductors are physically non-parallel.

9. The electrical heater element of claim 5 wherein said conductors are mounted within a tube from which the terminals extend.

10. The electrical element of claim 9 wherein said tube is a quartz tube.

11. The electrical element of claim 5 wherein the conductors form a helix.

12. The electrical element of claim 5 wherein the conductors are metallic.

13. The electrical element of claim 12 wherein the metal is an alloy consisting of iron, aluminum, cobalt and chromium.

14. A method of producing an electrical heater element which comprises:

providing at least two electrical conductors;

twisting the electrical conductors about each other such that the electrical conductors have a lay distance which is between about 9 and 11 times greater than the individual diameter of the conductors; and coiling the twisted conductors about a fixed axis.

15. The method of claim 14 which further comprises the step of mounting the coiled structure within a heat-radiation tube.

16. A resistive heating element comprising:

first and second resistance wires, said wires defining respective longitudinal axes and being disposed in continuous uninterrupted substantially mutually supporting contacting relation along said longitudinal axes, said first and second wires having a lay distance which is between about 9 and 11 times greater than the cross-sectional distance of said conductors.

17. A resistive heating element as in claim 16 wherein said first and second resistance wires are tightly twisted together along said longitudinal axes.

18. A resistive heating element as in claim 17 wherein said first and second resistance wires are formed into a helix of coils.

19. An electrical heater comprising:

a resistive heating element having first and second resistance wires defining respective longitudinal axes and being twisted in a substantially mutually supporting contacting relation along said longitudinal axes such that said resistive heating element has a lay distance which is between 9 and 11 times greater than the individual diameter of said first and second resistance wires; and electrical means, forming an electrical connection at each end of said twisted wires, for applying a source of electrical power across said helix through said connections.

20. A method of forming a resistive heating element comprising the steps of:

providing first and second resistance wires defining respective longitudinal axes; and twisting said first and second resistance wires about one another into substantially mutually supporting contacting relation along said longitudinal axes such that said resistive heating element has a lay distance which is between about 9 and 11 times greater than the individual diameter of said first and second resistance wires.

21. The method of claim 20 further comprising the step of forming said twisted first and second resistance wires into a coiled helix.

* * * * *